US011348546B2

(12) United States Patent
Hu

(10) Patent No.: US 11,348,546 B2
(45) Date of Patent: May 31, 2022

(54) DISPLAY PANEL AND DRIVING METHOD THEREOF

(71) Applicants: HKC Corporation Limited, Guangdong (CN); Chongqing HKC Optoelectronics Technology Co., Ltd., Chongqing (CN)

(72) Inventor: Shuixiu Hu, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/624,031

(22) PCT Filed: Aug. 31, 2017

(86) PCT No.: PCT/CN2017/099968
§ 371 (c)(1),
(2) Date: Dec. 18, 2019

(87) PCT Pub. No.: WO2018/233040
PCT Pub. Date: Dec. 27, 2018

(65) Prior Publication Data

US 2020/0349897 A1 Nov. 5, 2020

(30) Foreign Application Priority Data

Jun. 19, 2017 (CN) ..... 201710466081.8

(51) Int. Cl.
*G09G 3/36* (2006.01)

(52) U.S. Cl.
CPC ..... *G09G 3/3614* (2013.01); *G09G 3/3659* (2013.01); *G09G 2310/0251* (2013.01)

(58) Field of Classification Search
CPC ..... G09G 2310/0251; G09G 3/3607; G09G 3/3614; G09G 3/3659; G09G 2300/0408;
(Continued)

(56) References Cited

U.S. PATENT DOCUMENTS 9,128,713 B2 9/2015 Knausz et al.
2004/0085272 A1* 5/2004 Ting ..... G02F 1/134336 345/87

(Continued)

FOREIGN PATENT DOCUMENTS

CN 1755444 A 4/2006
CN 203909431 U 10/2014

(Continued)

*Primary Examiner* — Richard J Hong
(74) *Attorney, Agent, or Firm* — Muncy, Geissler, Olds & Lowe, P.C.

(57) ABSTRACT

A driving method of a display panel includes: dividing a plurality of sub-pixels arranged in a matrix into a plurality of sub-pixel column sets, wherein each of the sub-pixel column sets comprises neighboring two columns of sub-pixels, a data line is disposed between the neighboring two columns of sub-pixels, and the neighboring two columns of sub-pixels are electrically connected to the data line; setting the row-adjacent sub-pixels to have opposite polarities; performing a first charge on a target sub-pixel in a first predetermined time period; and performing a second charge on the target sub-pixel in a second predetermined time period, while performing a first charge on a next sub-pixel electrically connected to the same data line electrically connected to the target sub-pixel, and has the polarity the same as the polarity of the target sub-pixel.

6 Claims, 7 Drawing Sheets

(58) Field of Classification Search
CPC ... G09G 2300/0426; G09G 2320/0219; G09G 2320/0233; G09G 3/3648; G09G 3/3677; G02F 1/136286; G02F 1/1368; G02F 1/134336; G02F 1/1393; H01L 27/124; H01L 27/1255
See application file for complete search history.

(56) References Cited

U.S. PATENT DOCUMENTS

| | | | | |
|---|---|---|---|---|
| 2006/0081850 | A1* | 4/2006 | Lee | G09G 3/3648 257/72 |
| 2006/0256248 | A1* | 11/2006 | Baek | G02F 1/1393 349/42 |
| 2008/0252624 | A1* | 10/2008 | Jang | G09G 3/3648 345/204 |
| 2013/0141660 | A1* | 6/2013 | Wang | G02F 1/136286 349/43 |
| 2016/0351151 | A1* | 12/2016 | Cao | G02F 1/136286 |
| 2017/0261826 | A1* | 9/2017 | Chen | H01L 27/1255 |
| 2018/0284510 | A1* | 10/2018 | Um | G02F 1/1368 |

FOREIGN PATENT DOCUMENTS

| | | | |
|---|---|---|---|
| CN | 105261342 | A | 1/2016 |
| CN | 205809498 | U | 12/2016 |

* cited by examiner

DISPLAY PANEL AND DRIVING METHOD THEREOF

CROSS REFERENCE TO RELATED APPLICATIONS

This Non-provisional application claims priority on Patent Application No. 201710466081.8, entitled "DISPLAY PANEL AND DRIVING METHOD THEREOF", filed in People's Republic of China on Jun. 19, 2017, the entire contents of which are hereby incorporated by reference.

BACKGROUND

Technical Field

This disclosure relates to a technical field of a display, and more particularly to a display panel and a driving method thereof.

Related Art

A thin film transistor liquid crystal display (TFT-LCD) is one of main varieties of current flat panel displays, and has become an important display platform in the modern IT and video products. According to the main driving principle of the TFT-LCD, a system mainboard connects a red/green/blue compression signal, a control signal and a power to a connector on a printed circuit board (PCB) through wires, and data is processed by a timing controller (TCON timing controller) chip on the PCB and then connected to a display region through the PCB and through a source drive chip (source-chip on film (S-COF)) and a gate drive chip (gate-chip on film, G-COF), so that the display obtains the required power and signals.

At present, many TFT-LCDs adopt the dual-gate pixel architecture. Compared with the ordinary pixel architecture, the number of the gate scan lines is doubled in the pixel architecture, so that "dual-gate" is named. In addition, each data line is connected to two sub-pixels on the layout, and thus the number of the data lines is decreased to one half as compared with the ordinary pixel architecture. When the first row of gate scan lines are turned on, a plurality of data lines charge the left side sub-pixel of the connected two sub-pixels. When the second row of gate scan lines are turned on, a plurality of data lines charge the right side sub-pixel of the connected two sub-pixels, so that the integrated display of the frame is performed by turning on the gate scan lines row by row. When the frame refresh frequency is f=60 Hz, the charge time of each sub-pixel is t=1/60 M (M is the number of the gate scan lines). Because the number of the gate scan lines is doubled in the dual-gate pixel architecture, the charge time of each sub-pixel is shortened, the charging efficiency is decreased, and the optical performance of the frame is finally decreased.

SUMMARY

In view of this, it is necessary to provide a display panel and a driving method thereof capable of enhancing the charging efficiency.

A driving method of a display panel comprises:

dividing a plurality of sub-pixels arranged in a matrix into a plurality of sub-pixel column sets, wherein each of the sub-pixel column sets comprises neighboring two columns of sub-pixels, a data line is disposed between the neighboring two columns of sub-pixels, and the neighboring two columns of sub-pixels are electrically connected to the data line;

setting the row-adjacent sub-pixels to have opposite polarities;

performing a first charge on a target sub-pixel in a first predetermined time period; and performing a second charge on the target sub-pixel in a second predetermined time period, while performing a first charge on a next sub-pixel electrically connected to the same data line electrically connected to the target sub-pixel, and has the polarity the same as the polarity of the target sub-pixel.

A display panel comprises:

a plurality of sub-pixels arranged in a matrix, wherein the plurality of sub-pixels constitute a plurality of sub-pixel column sets, and each of the sub-pixel column sets comprises neighboring two columns of sub-pixels;

a driving circuit comprising a data line, wherein the data line is disposed between the neighboring two columns of sub-pixels, and the neighboring two columns of sub-pixels are electrically connected to the data line;

a control module configured to set the row-adjacent sub-pixels in the plurality of sub-pixels arranged in the matrix to have opposite polarities; And a charge module configured to perform a first charge on a target sub-pixel in a first predetermined time period, and further configured to perform a second charge on the target sub-pixel in a second predetermined time period, while performing a first charge on a next sub-pixel electrically connected to the same data line electrically connected to the target sub-pixel, and has the polarity the same as the polarity of the target sub-pixel.

A driving method of a display panel comprises:

dividing a plurality of sub-pixels arranged in a matrix into a plurality of sub-pixel column sets, wherein each of the sub-pixel column sets comprises neighboring two columns of sub-pixels, a data line is disposed between the neighboring two columns of sub-pixels, and the neighboring two columns of sub-pixels are electrically connected to the data line;

setting the row-adjacent sub-pixels to have opposite polarities;

performing a first charge on a target sub-pixel in a first predetermined time period, while performing a second charge on a previous sub-pixel electrically connected to the same data line electrically connected to the target sub-pixel, and has the polarity the same as the polarity of the target sub-pixel; and performing a second charge on the target sub-pixel in a second predetermined time period, while performing a first charge on a next sub-pixel electrically connected to the same data line electrically connected to the target sub-pixel, and has the polarity the same as the polarity of the target sub-pixel.

In the above-mentioned display panel and the driving method thereof, because the dual-gate sub-pixel architecture is used, the number of the gate scan lines is doubled, the single charge time of the gate scan line of each sub-pixel is shortened to one half. Thus, a first charge is performed on the target sub-pixel in the first predetermined time period to implement the pre-charging of the target sub-pixel, and then a second charge is performed on the target sub-pixel using the actual voltage in the second predetermined time period, wherein the first charge and the second charge have the same polarity, so that a pre-charge is performed before the second charge is performed using the actual voltage, and the second charge does not start from zero any more. In this case, the predetermined target value can be reached in a short time, the target sub-pixel is charged twice, the charge time is lengthened, the charging efficiency is enhanced, the optical performance of the frame is improved, the requirement on the process is not changed, and the product cost is not increased.

BRIEF DESCRIPTION OF THE DRAWINGS

The embodiments will become more fully understood from the detailed description and accompanying drawings, which are given for illustration only, and thus are not limitative of the present invention, and wherein.

DETAILED DESCRIPTION OF THE INVENTION

The embodiments of the invention will be apparent from the following detailed description, which proceeds with reference to the accompanying drawings, wherein the same references relate to the same elements.

Figure 1:
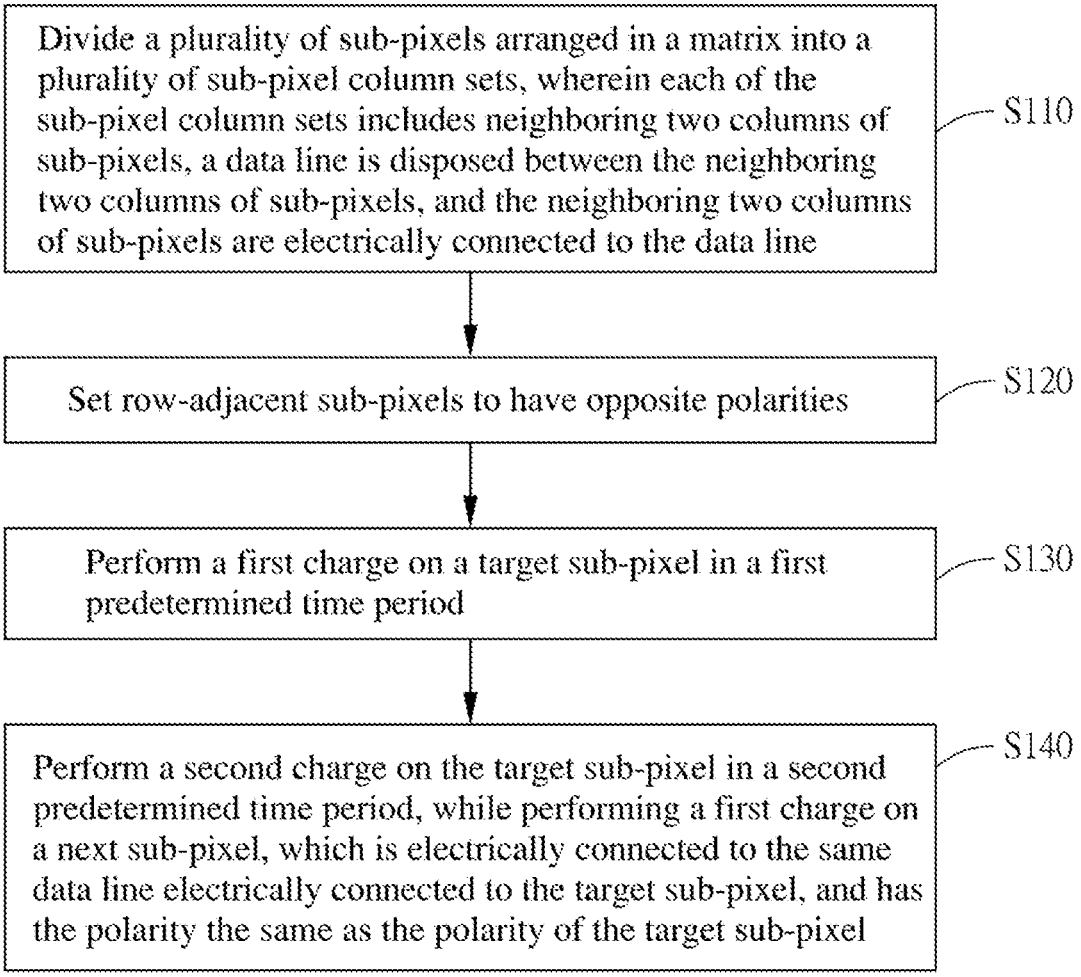
FIG. 1 is a flow chart showing a driving method of a display panel in an embodiment.

FIG. 1 is a flow chart showing a driving method of a display panel, wherein the display panel includes a plurality of sub-pixels arranged in a matrix; the display panel includes a plurality of data lines vertically disposed, and a plurality of gate scan lines horizontally disposed; and the method includes steps S110 to S140.

In the step S110, a plurality of sub-pixels arranged in a matrix are divided into a plurality of sub-pixel column sets, wherein each of the sub-pixel column sets includes neighboring two columns of sub-pixels, a data line is disposed between the neighboring two columns of sub-pixels, and the neighboring two columns of sub-pixels are electrically connected to the data line.

In the step S120, row-adjacent sub-pixels are set to have opposite polarities.

In the step S130, a first charge is performed on a target sub-pixel in a first predetermined time period.

In the step S140, a second charge is performed on the target sub-pixel in a second predetermined time period, while a first charge is performed on a next sub-pixel, which is electrically connected to the same data line electrically connected to the target sub-pixel, and has the polarity the same as the polarity of the target sub-pixel.

Because the dual-gate sub-pixel architecture is used, the number of the gate scan lines is doubled, the single charge time of the gate scan line of each sub-pixel is shortened to one half Thus, a first charge is performed on the target sub-pixel in the first predetermined time period to implement the pre-charging of the target sub-pixel, and then a second charge is performed on the target sub-pixel using the actual voltage in the second predetermined time period, wherein the first charge and the second charge have the same polarity, so that a pre-charge is performed before the second charge is performed using the actual voltage, and the second charge does not start from zero any more. In this case, the predetermined target value can be reached in a short time, the target sub-pixel is charged twice, the charge time is lengthened, the charging efficiency is enhanced, the optical performance of the frame is improved, the requirement on the process is not changed, and the product cost is not increased. The method can be applied to a display panel of the dual-gate sub-pixel architecture.

In the embodiment, the method further comprises: one gate scan line is disposed on each of top and bottom sides of each of the rows of the sub-pixels. One of the columns of the sub-pixels of the sub-pixel column set are electrically connected to the gate scan line on the top side of the column sub-pixel, and another column of the sub-pixels of the sub-pixel column set are electrically connected to the gate scan line on the bottom side of the column sub-pixel.

Figure 2:
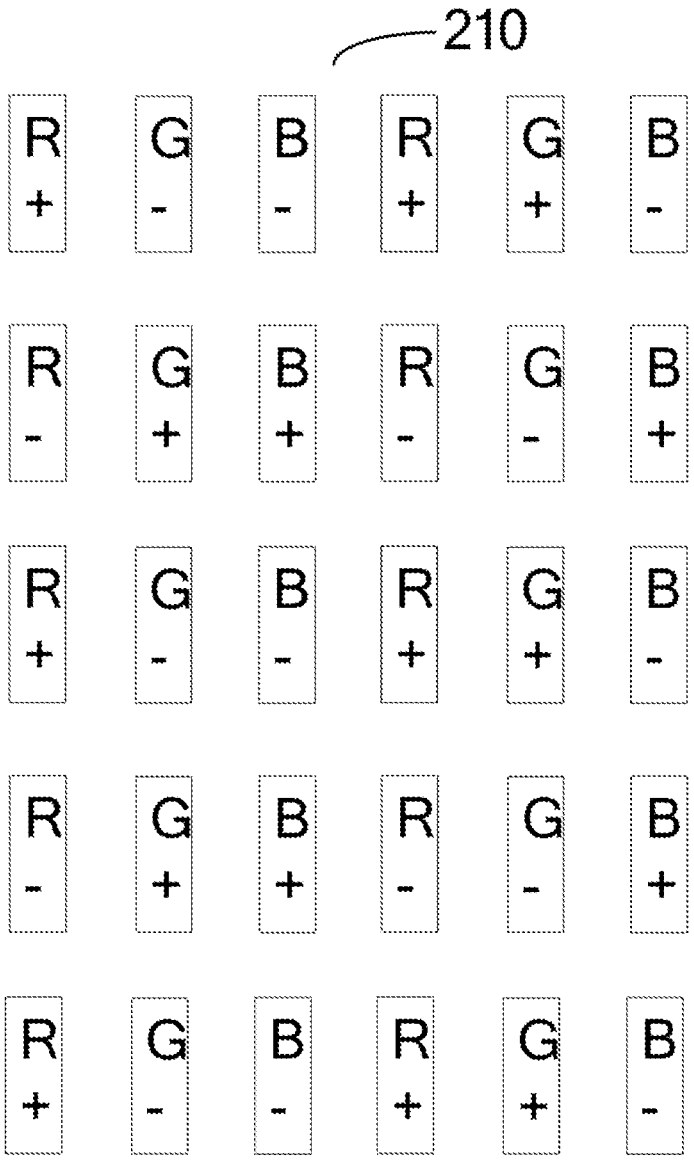
FIG. 2 is a schematic view showing polarity distributions of sub-pixels in an embodiment.
Figure 3:
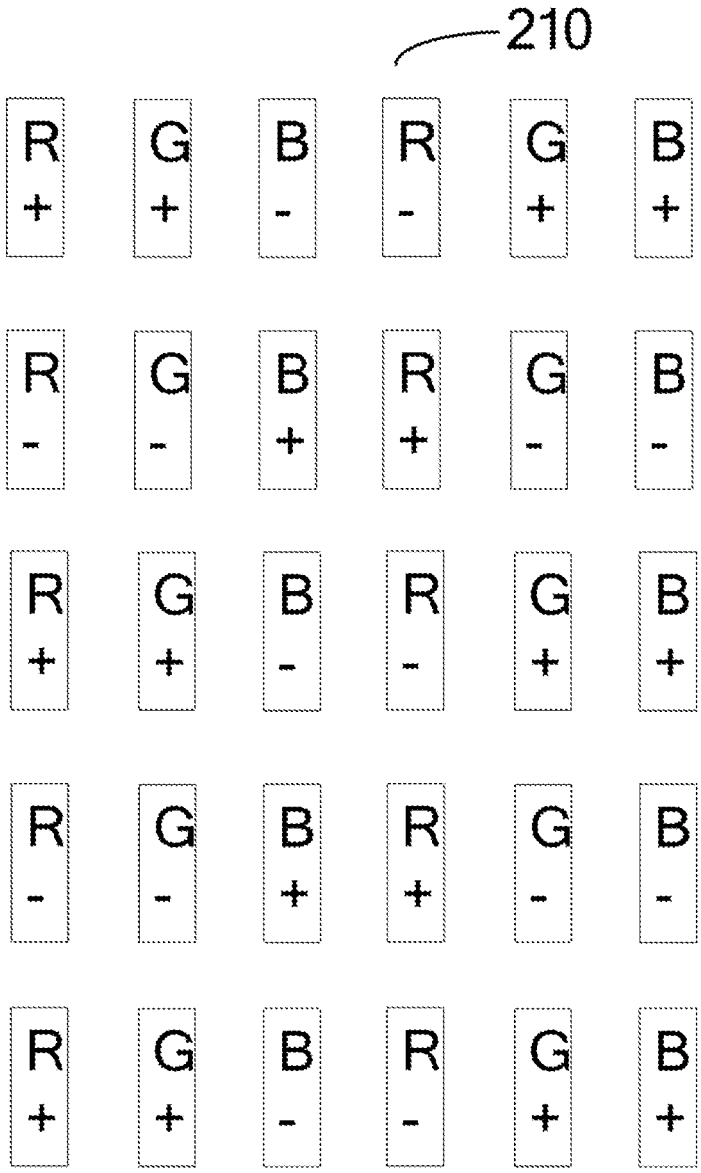
FIG. 3 is a schematic view showing polarity distributions of sub-pixels in another embodiment.

The method further includes the following features. The sub-pixel architecture can have two data reversal aspects including (1+2n)-row and (2n)-row data reversals, where n is a natural number. The (1+2n)-row data reversal represents that the polarities of the data on a certain data line are "+ − − + + + − −" or "− + + − − + +", so that the display of the polarity of the data of the sub-pixel 210 shown in FIG. 2 can be obtained. Thus, the same row of two sub-pixels of the neighboring two columns of sub-pixels 210 in each of the sub-pixel column sets have the opposite polarities. The (2n)-rows data reversal represents that the polarities of the data on a certain data line are "− − + + − −" or "+ +− − + +", so that the display of the polarity of the data of the sub-pixel 210 shown in FIG. 3 can be obtained. Thus, the same row of two sub-pixels of the neighboring two columns of sub-pixels 210 in each of the sub-pixel column sets have the opposite polarities. The polarities of the data of the horizontal and vertical sub-pixels 210 are different so that make the display uniform and reduce the flicker.

Figure 4:
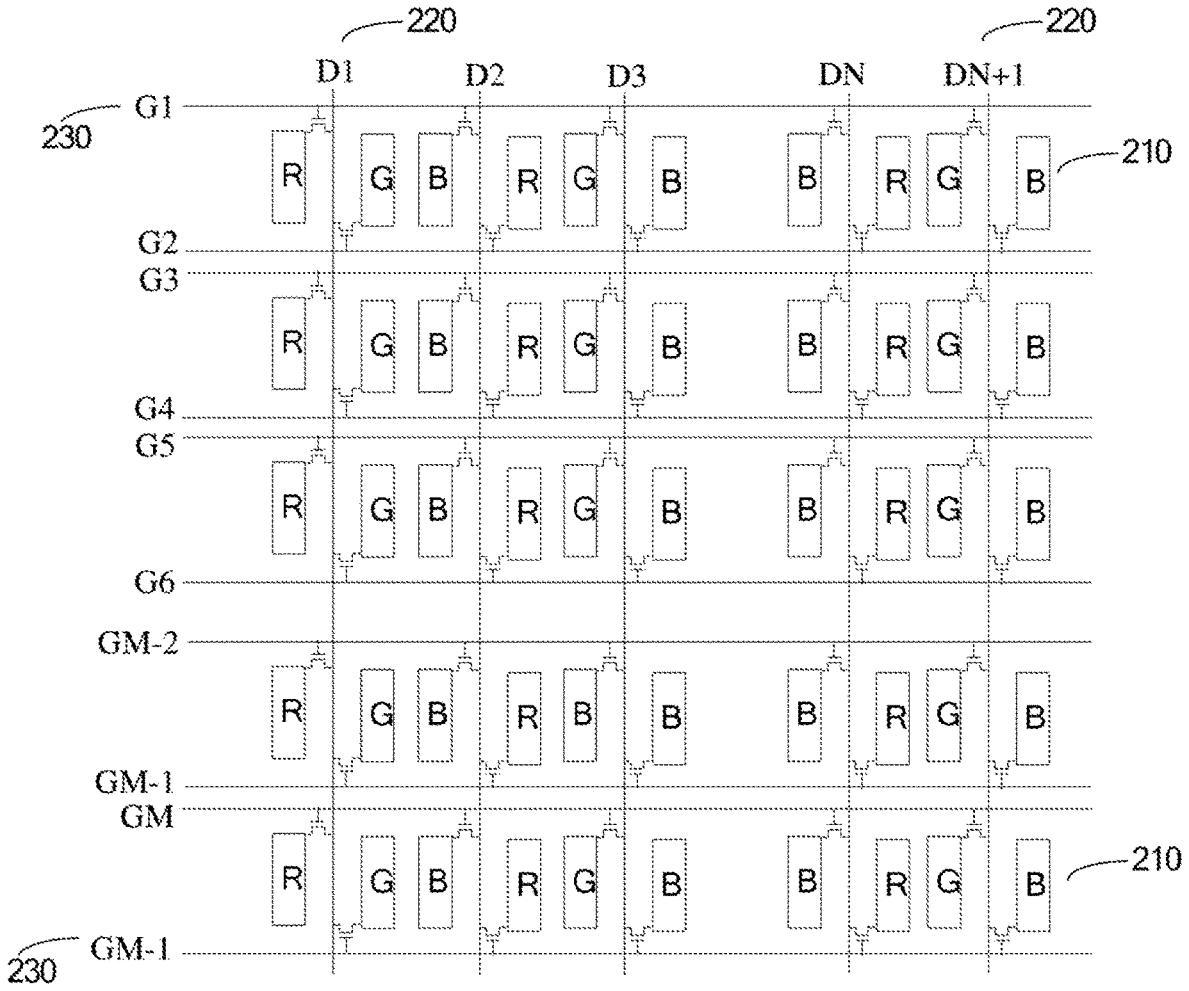
FIG. 4 is a schematic view showing the architecture of the sub-pixels of the display panel in an embodiment.

FIG. 4 is a schematic view showing the architecture of the sub-pixels of the display panel. Compared with the ordinary sub-pixel architecture, the number of the gate scan lines 230 is doubled in this sub-pixel architecture. In addition, each data line 220 is connected to two sub-pixels 210 on the layout, so that the number of the data lines 220 is decreased to one half on the layout as compared with the ordinary sub-pixel architecture.

When the first row of gate scan lines G1 are turned on, the data lines D1, D2, . . . , DN and DN+1 charge the left side sub-pixels of the connected two sub-pixels. When the second row of gate scan lines G2 are turned on, the data lines D1, D2, . . . , DN and DN+1 charge the right side sub-pixels of the connected two sub-pixels, so that the integrated display of the frame is performed by turning on the gate scan lines row by row. When the frame refresh frequency is f=60 Hz, the charge time of each sub-pixel is t=1/60 M (M is the number of the gate scan lines). Because the number of the gate scan lines is doubled, the single charge time of each gate scan line on each sub-pixel is shortened.

The polarity reversal signal (POL) is detected inside the timing controller (TCON) of the display panel. For the sub-pixel on the same data line, when the polarity of the data on the $M^{th}$ gate scan line and the polarity of the data on the $(M+1)^{th}$ gate scan line are the same, to dual-scan charge the sub-pixels on the two gate scan lines is performed. When the sub-pixels on the $M^{th}$ gate scan line are charged at the second time (i.e., actually charged), the sub-pixels on the $(M+1)^{th}$ gate scan line are charged at the first time (i.e., pre-charged). When the polarity of the data on the $M^{th}$ gate scan line and the polarity of the data on the $(M+1)^{th}$ gate scan line are different, the next sub-pixels having the same polarity on the same data line are scanned and charged. According to the data reversal of the above-mentioned embodiment, it is obtained that the polarities of the data of the sub-pixels on the $M^{th}$ and the $(M+3)^{th}$ gate scan lines are the same, and the sub-pixels on the $M^{th}$ and the $(M+3)^{th}$ gate scan lines are dual-scan charged. That is, when the sub-pixels on the $M^{th}$ gate scan line are charged at the second time (i.e., actually charged), the sub-pixels on the $(M+3)^{th}$ gate scan line are charged at the first time (i.e., pre-charged).

Figure 5:
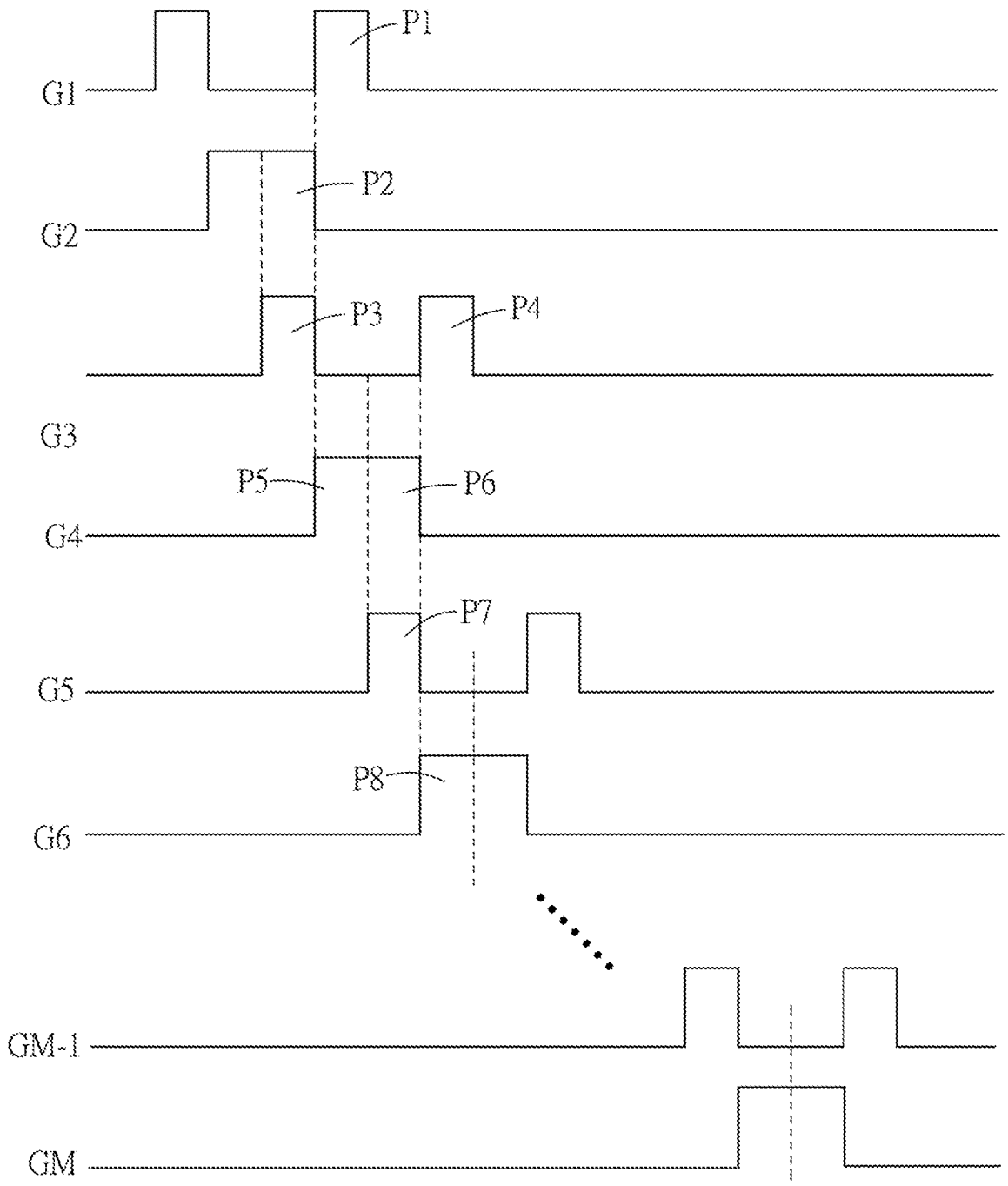
FIG. 5 is a timing chart showing driving signals of gate scan lines in an embodiment.

FIG. 5 shows the driving signal of the gate scan line upon the dual-scan charge. The gate scan line signal turns on each of the rows of the sub-pixels row by row, each row of gate scan line signals are divided into two predetermined time period. A first charge is performed with other sub-pixel voltages having the same polarity in the first predetermined time period (that is, a pre-charge period), and a second charge is performed with the actual voltage to be set in the second predetermined time period, that is, there are only two rows of thin film transistors (TFTs) turned on at the same time. The charge time of the first predetermined time period can be equal to the charge time of the second predetermined time period, thereby facilitating the operation. The first predetermined time period and the second predetermined time period neighbor upon each other or are disposed with two charge times interposed therebetween.

Specifically, taking the data reversal of (1+2n) rows as an example in the following, the polarity of the row data of the gate scan line G1 is consistent with the polarity of the row data of the gate scan line G4, so that when the thin film transistor is charged with the actual voltage in the row of the gate scan line G1, the row sub-pixels of the gate scan line G4 are pre-charged, as shown by the pulses P1 and P5 in FIG. 5. The polarity of the row data of the gate scan line G2 is consistent with the polarity of the row data of the gate scan line G3, so that when the sub-pixel is charged with the actual voltage in the row of the gate scan line G2, the row sub-pixels of the gate scan line G3 are pre-charged, as shown by the pulses P2 and P3 in FIG. 5. The polarity of the row data of the gate scan line G3 is consistent with the polarity of the row data of the gate scan line G6, so that when the sub-pixel is charged with the actual voltage in the row of the gate scan line G3, the row sub-pixels of the gate scan line G6 are pre-charged, as shown by the pulses P4 and P8 in FIG. 5. The polarity of the row data of the gate scan line G4 is consistent with the polarity of the row data of the gate scan line G5, so that when the sub-pixel is charged with the actual voltage in the row of the gate scan line G4, the row sub-pixels of the gate scan line G5 are pre-charged, as shown by the pulses P6 and P7 in FIG. 5. Similarly, the other row having the same data polarity can be pre-charged with the actual voltage in every subsequent row. Similarly, when the data reversal corresponds to (2n) rows, a similar method is used to charge the sub-pixels.

Figure 6:
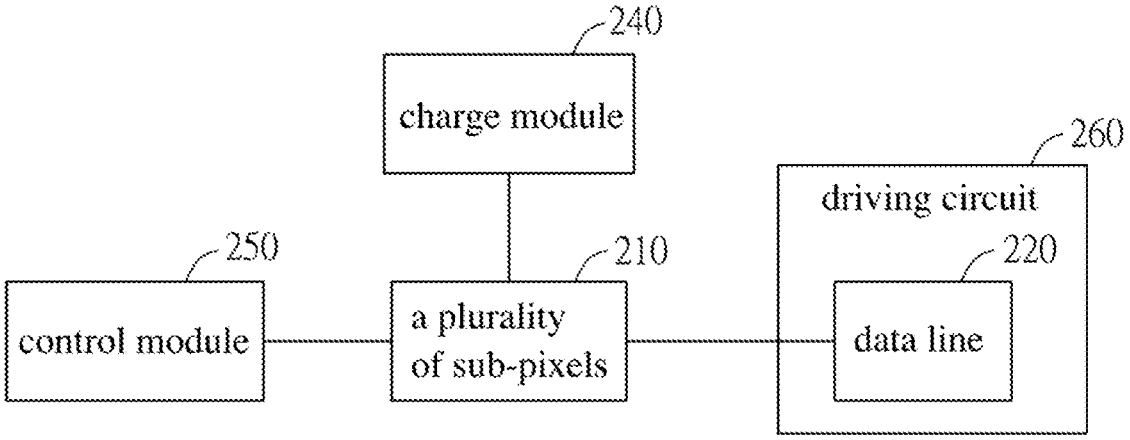
FIG. 6 is a block diagram showing a display panel in an embodiment.

FIG. 6 is a block diagram showing a display panel in an embodiment. The display panel includes a plurality of sub-pixels arranged in a matrix 210, a driving circuit 260, a charge module 240 and a control module 250, wherein the driving circuit 260 includes a data line 220.

In view of FIG. 4, a plurality of sub-pixels 210 are arranged in a matrix. The plurality of sub-pixels 210 constitute a plurality of sub-pixel column sets, and each of the sub-pixel column sets comprises neighboring two columns of sub-pixels The data line 220 is disposed between the neighboring two columns of sub-pixels, and the neighboring two columns of sub-pixels are electrically connected to the data line 220.

The control module 250 is configured to set the row-adjacent sub-pixels in the plurality of sub-pixels arranged in the matrix to have opposite polarities.

The charge module 240 is configured to perform a first charge on a target sub-pixel in a first predetermined time period. The charge module 240 is further configured to perform a second charge on the target sub-pixel in a second predetermined time period, while performing a first charge on a next sub-pixel electrically connected to the same data line 220 electrically connected to the target sub-pixel, and has the polarity the same as the polarity of the target sub-pixel.

The driving circuit may further include a plurality of data lines 220 vertically disposed and a plurality of gate scan lines 230 horizontally disposed. One gate scan line is disposed on each of top and bottom sides of each of the rows of the sub-pixels. One of the columns of the sub-pixels of the sub-pixel column set are electrically connected to the gate scan line on the top side of the column sub-pixel, and another column of the sub-pixels of the sub-pixel column set are electrically connected to the gate scan line on the bottom side of the column sub-pixel. Because the dual-gate sub-pixel architecture is used, the number of the gate scan lines is doubled, the single charge time of the gate scan line of each sub-pixel is shortened to one half. Thus, a first charge is performed on the target sub-pixel in the first predetermined time period to implement the pre-charging of the target sub-pixel, and then a second charge is performed on the target sub-pixel using the actual voltage in the second predetermined time period, wherein the first charge and the second charge have the same polarity, so that a pre-charge is performed before the second charge is performed using the actual voltage, and the second charge does not start from zero any more. In this case, the predetermined target value can be reached in a short time, the target sub-pixel is charged twice, the charge time is lengthened, the charging efficiency is enhanced, the optical performance of the frame is improved, the requirement on the process is not changed, and the product cost is not increased.

The sub-pixel architecture can have two data reversal aspects including (1+2n)-row and (2n)-row data reversals, where n is a natural number. The (1+2n)-row data reversal represents that the polarities of the data on a certain data line are "+ − − + + − −" or "− + +− − + +", so that the display of the polarity of the data of the sub-pixel 210 shown in FIG. 2 can be obtained. Thus, the same row of two sub-pixels of the neighboring two columns of sub-pixels 210 in each of the sub-pixel column sets have the opposite polarities. The (2n)-rows data reversal represents that the polarities of the data on a certain data line are "− −+ + − −" or "+ + − − + +", so that the display of the polarity of the data of the sub-pixel 210 shown in FIG. 3 can be obtained. Thus, the same row of two sub-pixels of the neighboring two columns of sub-pixels 210 in each of the sub-pixel column sets have the opposite polarities. The polarities of the data of the horizontal and vertical sub-pixels 210 are different so that make the display uniform and reduce the flicker.

The charge module further performs a first charge on the target sub-pixel, while performing a second charge on a previous sub-pixel electrically connected to the same data line electrically connected to the target sub-pixel, and has the polarity the same as the polarity of the target sub-pixel.

The polarity reversal signal (POL) is detected inside the timing controller (TCON) of the display panel. For the sub-pixel on the same data line, when the polarity of the data on the $M^{th}$ gate scan line and the polarity of the data on the $(M+1)^{th}$ gate scan line are the same, the charge module is used to dual-scan charge the sub-pixels on the two gate scan lines. When the sub-pixels on the $M^{th}$ gate scan line are charged at the second time (i.e., actually charged), the sub-pixels on the $(M+1)^{th}$ gate scan line are charged at the first time (i.e., pre-charged). When the polarity of the data on the $M^{th}$ gate scan line and the polarity of the data on the $(M+1)^{th}$ gate scan line are different, the next sub-pixels having the same polarity on the same data line are scanned and charged. According to the data reversal of the above-mentioned embodiment, it is obtained that the polarities of the data of the sub-pixels on the $M^{th}$ and the $(M+3)^{th}$ gate scan lines are the same, and the sub-pixels on the $M^{th}$ and the $(M+3)^{th}$ gate scan lines are dual-scan charged. That is, when the sub-pixels on the $M^{th}$ gate scan line are charged at the second time (i.e., actually charged), the sub-pixels on the $(M+3)^{th}$ gate scan line are charged at the first time (i.e., pre-charged).

The display panel further comprises a timer configured to calculate a charge time of the first predetermined time period and a charge time of the second predetermined time period. A charge time of the first predetermined time period is equal to a charge time of the second predetermined time period, and the first predetermined time period and the second predetermined time period neighbor upon each other or are disposed with two charge times interposed therebetween. FIG. 5 shows the driving signal of the gate scan line upon the dual-scan charge. The gate scan line signal turns on each of the rows of the sub-pixels row by row, each row of gate scan line signals are divided into two predetermined time period. A first charge is performed with other sub-pixel voltages having the same polarity in the first predetermined time period (that is, a pre-charge period), and a second charge is performed with the actual voltage to be set in the second predetermined time period, that is, there are only two rows of thin film transistors (TFTs) turned on at the same time. The charge time of the first predetermined time period can be equal to the charge time of the second predetermined time period, thereby facilitating the operation. The first predetermined time period and the second predetermined time period neighbor upon each other or are disposed with two charge times interposed therebetween.

Further, taking the data reversal of (1+2n) rows as an example in the following, the polarity of the row data of the gate scan line G1 is consistent with the polarity of the row data of the gate scan line G4, so that when the thin film transistor is charged with the actual voltage in the row of the gate scan line G1, the row sub-pixels of the gate scan line G4 are pre-charged, as shown by the pulses P1 and P5 in FIG. 5. The polarity of the row data of the gate scan line G2 is consistent with the polarity of the row data of the gate scan line G3, so that when the sub-pixel is charged with the actual voltage in the row of the gate scan line G2, the row sub-pixels of the gate scan line G3 are pre-charged, as shown by the pulses P2 and P3 in FIG. 5. The polarity of the row data of the gate scan line G3 is consistent with the polarity of the row data of the gate scan line G6, so that when the sub-pixel is charged with the actual voltage in the row of the gate scan line G3, the row sub-pixels of the gate scan line G6 are pre-charged, as shown by the pulses P4 and P8 in FIG. 5. The polarity of the row data of the gate scan line G4 is consistent with the polarity of the row data of the gate scan line G5, so that when the sub-pixel is charged with the actual voltage in the row of the gate scan line G4, the row sub-pixels of the gate scan line G5 are pre-charged, as shown by the pulses P6 and P7 in FIG. 5. Similarly, the other row having the same data polarity can be pre-charged with the actual voltage in every subsequent row. Similarly, when the data reversal corresponds to (2n) rows, a similar method is used to charge the sub-pixels.

Each of the gate scan lines in the display panel is turned on twice, the first charge is performed on each of the sub-pixels at the first time with other pixel voltages having the same polarity, and the second charge is performed on each of the sub-pixels charged with the actual pixel voltage. The polarity reversal signal is detected inside the timing controller. When the polarities of certain two rows of data are detected as the same, the two rows of the sub-pixels are dual-scan charged. After the pre-charge mode is adopted, the charge time of each of the sub-pixels is lengthened so that the charging efficiency is enhanced, and the optical performance of the frame is improved. In a precondition without increasing the cost, the problem that the charging efficiency of the sub-pixel architecture is reduced due to the doubling of the gate scan lines is solved, and the requirements for the process are kept unchanged.

The display panel can be a TN (Twisted Nematic), OCB (Optically Compensated Birefringence), or VA (Vertical Alignment) LCD panel, and this disclosure is not limited thereto. The display panel can be a RGB panel, a RGBW panel, or a RGBY panel, and this disclosure is not limited thereto. The driving method can also be applied to a curved display panel.

In some embodiments, the display panel can be, for example, an OLED display panel, a QLED display panel, a curved display panel or other display panels, and this disclosure is not limited.

Figure 7:
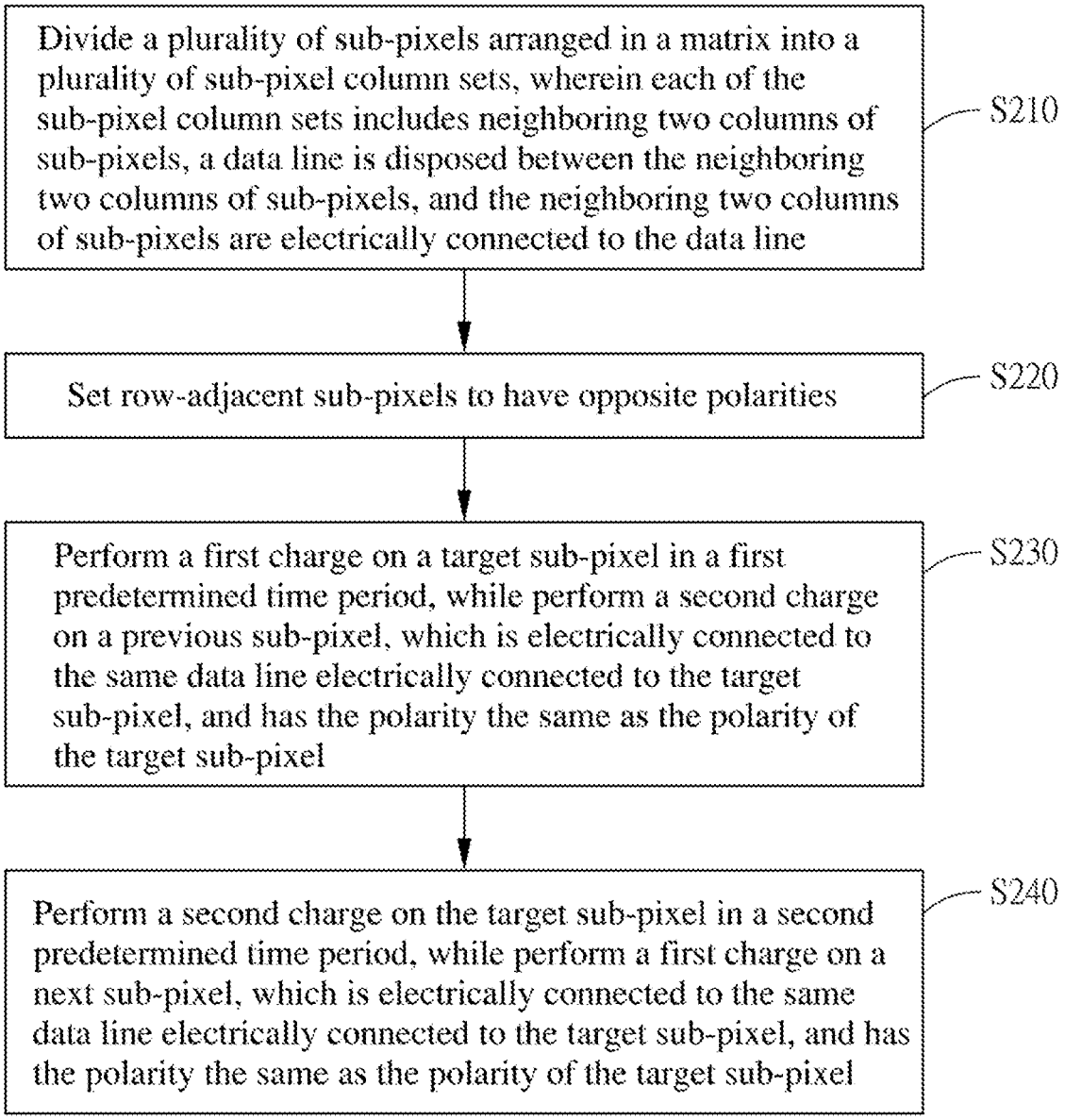
FIG. 7 is a flow chart showing a driving method of a display panel according to another embodiment.

FIG. 7 is a flow chart showing a driving method of a display panel according to another embodiment. In the step S210, a plurality of sub-pixels arranged in a matrix are divided into a plurality of sub-pixel column sets, wherein each of the sub-pixel column sets includes neighboring two columns of sub-pixels, a data line is disposed between the neighboring two columns of sub-pixels, and the neighboring two columns of sub-pixels are electrically connected to the data line.

In the step S220, row-adjacent sub-pixels are set to have opposite polarities.

In the step S230, a first charge is performed on a target sub-pixel in a first predetermined time period, while a second charge is performed on a previous sub-pixel, which is electrically connected to the same data line electrically connected to the target sub-pixel, and has the polarity the same as the polarity of the target sub-pixel.

In the step S240, a second charge is performed on the target sub-pixel in a second predetermined time period, while a first charge is performed on a next sub-pixel, which is electrically connected to the same data line electrically connected to the target sub-pixel, and has the polarity the same as the polarity of the target sub-pixel.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A driving method of a display panel, comprising:

dividing a plurality of sub-pixels arranged in a matrix into a plurality of sub-pixel column sets and a plurality of rows of the sub-pixels, wherein each of the sub-pixel column sets comprises two neighboring columns of sub-pixels, a data line is disposed between the two neighboring columns of sub-pixels, and the two neighboring columns of sub-pixels are electrically connected to the data line disposed therebetween, and wherein one gate scan line is disposed on each of top and bottom sides of each of the rows of the sub-pixels, one of the columns of the sub-pixels of the sub-pixel column set are electrically connected to the gate scan line on the top side of the column sub-pixel, and another column of the sub-pixels of the sub-pixel column set are electrically connected to the gate scan line on the bottom side of the column sub-pixel, and a gate scan line signal turns on each of the rows of the sub-pixels row by row;

setting the row-adjacent sub-pixels to have opposite polarities;

setting the two neighboring columns of sub-pixels connected to the data line disposed therebetween in each of the sub-pixel column sets to have opposite polarities;

performing a first charge on a target sub-pixel in a first predetermined time period;

performing a second charge on the target sub-pixel in a second predetermined time period, while performing a first charge on a next sub-pixel electrically connected to the same data line electrically connected to the target sub-pixel, wherein a polarity of the next sub-pixel is the same as a polarity of the target sub-pixel; and performing a first charge on the target sub-pixel, while performing a second charge on a previous sub-pixel of the same sub-pixel column set electrically connected to the same data line electrically connected to the target sub-pixel, and has the polarity the same as the polarity of the target sub-pixel.

2. The driving method according to claim 1, wherein:

a charge time of the first predetermined time period is equal to a charge time of the second predetermined time period.

3. The driving method according to claim 1, wherein:

the first predetermined time period and the second predetermined time period neighbor upon each other.

4. The driving method according to claim 1, wherein:

the first predetermined time period and the second predetermined time period are disposed with two charge times interposed therebetween.

5. A display panel, comprising:

a plurality of sub-pixels arranged in a matrix, wherein the plurality of sub-pixels constitute a plurality of sub-pixel column sets and a plurality of rows of the sub-pixels, and each of the sub-pixel column sets comprises two neighboring columns of sub-pixels;

a driving circuit comprising a data line disposed between the two neighboring columns of sub-pixels and a plurality of gate scan lines disposed horizontally, wherein the two neighboring columns of sub-pixels are electrically connected to the data line disposed therebetween, and wherein two of the gate scan lines are respectively disposed on each of top and bottom sides of each of the rows of the sub-pixels, one of the columns of the sub-pixels of the sub-pixel column set are electrically connected to the gate scan line on the top side of the column sub-pixel, and another column of the sub-pixels of the sub-pixel column set are electrically connected to the gate scan line on the bottom side of the column sub-pixel, and a gate scan line signal turns on each of the rows of the sub-pixels row by row;

a control module configured to set the row-adjacent sub-pixels in the plurality of sub-pixels arranged in the matrix to have opposite polarities; and a charge module configured to perform a first charge on a target sub-pixel in a first predetermined time period; configured to perform a second charge on the target sub-pixel in a second predetermined time period, while performing a first charge on a next sub-pixel electrically connected to the same data line electrically connected to the target sub-pixel, and has the polarity the same as the polarity of the target sub-pixel; and configured to performing a first charge on the target sub-pixel, while performing a second charge ono a previous sub-pixel of the same sub-pixel column set electrically connected to the same data line electrically connected to the target sub-pixel, and has the polarity the same as the polarity of the target sub-pixel, wherein the two neighboring columns of sub-pixels having the data line therebetween in each of the sub-pixel column sets have opposite polarities.

6. The display panel according to claim 5, further comprising:

a timer configured to calculate a charge time of the first predetermined time period and a charge time of the second predetermined time period;

wherein a charge time of the first predetermined time period is equal to a charge time of the second predetermined time period, and the first predetermined time period and the second predetermined time period neighbor upon each other or are disposed with two charge times interposed therebetween.

* * * * *